US008057370B2

(12) United States Patent
Dunn

(10) Patent No.: US 8,057,370 B2
(45) Date of Patent: Nov. 15, 2011

(54) RESISTANCE APPARATUS

(75) Inventor: Kipton William Dunn, Leawood, KS (US)

(73) Assignee: Dunn Concepts, LLC, Leawood, KS (US)

( * ) Notice: Subject to any disclaimer, the term of this patent is extended or adjusted under 35 U.S.C. 154(b) by 7 days.

(21) Appl. No.: 12/776,390

(22) Filed: May 8, 2010

(65) Prior Publication Data

US 2010/0292057 A1 Nov. 18, 2010

Related U.S. Application Data

(60) Provisional application No. 61/216,284, filed on May 15, 2009.

(51) Int. Cl.
*A63B 21/00* (2006.01)

(52) U.S. Cl. ..... 482/121; 482/904

(58) Field of Classification Search ..... 482/904, 482/907

See application file for complete search history.

(56) References Cited

U.S. PATENT DOCUMENTS

| | | | |
|---|---|---|---|
| 1,750,549 | A | 3/1930 | Thomson et al. |
| 3,618,942 | A | 11/1971 | Bates et al. |
| D230,613 | S | 3/1974 | Coker et al. |
| 3,815,904 | A | 6/1974 | Weiss et al. |
| D268,508 | S | 4/1983 | Silberman et al. |
| 4,493,275 | A | 1/1985 | Fischer |
| 4,720,096 | A | 1/1988 | Rogers |
| 4,779,867 | A | 10/1988 | Hinds |
| 4,852,873 | A | 8/1989 | O'Donnell et al. |
| 5,040,785 | A | 8/1991 | Charnitski |
| 5,112,287 | A | 5/1992 | Brewer |
| 5,176,602 | A | 1/1993 | Roberts |
| D347,041 | S | 5/1994 | Calderone |
| 5,431,617 | A | 7/1995 | Rattray, Jr. |
| D372,507 | S | 8/1996 | Chin |
| 5,755,646 | A | 5/1998 | Chu |
| 5,865,713 | A | 2/1999 | Hsu |
| 6,171,221 | B1 | 1/2001 | Hayduk |
| D439,943 | S | 4/2001 | Webber et al. |
| 6,328,571 | B1 | 12/2001 | Dricken et al. |
| 6,357,079 | B1 | 3/2002 | Hsu |
| 6,971,977 | B1 | 12/2005 | Chen |
| 6,976,745 | B2 | 12/2005 | Dobler et al. |
| 7,056,269 | B2 | 6/2006 | Cleveland et al. |
| 7,063,398 | B2 | 6/2006 | Hoffman |
| 7,189,190 | B2 | 3/2007 | Lamar et al. |

*Primary Examiner* — Jerome W Donnelly

(74) *Attorney, Agent, or Firm* — Hovey Williams LLP; Adam C. Rehm

(57) ABSTRACT

A resistance apparatus includes a track adapted to be secured in a vertical position on a support. A vertical slide is mounted and slideable and has on the track a spring loaded plunger near a first end thereof. A hook is mounted on the slide and has a pair of spaced apart legs, with upper and lower end portions, with the lower end portions of the legs connected by an upwardly extending U-shape portion. The upper end portion of the second leg has a downwardly extending curved portion which is laterally spaced from the upper end portion of the first leg to form therewith an entrance opening into the interior of the hook. A resistance band has an intermediate portion which is received in the interior of the hook through the entrance opening to permit a person to grasp the ends of the resistance band and to perform various resistance exercises.

17 Claims, 2 Drawing Sheets

RESISTANCE APPARATUS

RELATED APPLICATION

This application claims the benefit of U.S. Provisional Application No. 61/216,284, filed May 15, 2009, and whose entire contents are hereby incorporated by reference.

BACKGROUND

The present disclosure relates to a resistance apparatus which may be used as an exercise device or kit.

There are numerous kinds of resistance devices which may be used as exercise and fitness equipment wherein such equipment is used for maintaining or rehabilitating certain muscle groups following surgery or injury. A resistance device may also be used for maintaining or achieving a desired fitness level. Various elaborate and specialized apparatus and devices are used effectively in gyms and fitness centers where movements are based on resistance to tensions or weights. However, due to space requirements for storage and use and also due to costs, such specialized devices are generally unavailable for home or private use in the office.

Many persons who are recovering from an injury or illness or who prefer to exercise privately on their own schedules without traveling to a gym or fitness center desire to perform such exercises in their home or in the office. Many simple exercising devices are available for home use which substitute exercises for the routines which are commonly performed only with gym equipment. However, many people prefer the professional gym routine and would like to use an exercising device to perform a variety of control exercises which they have been accustomed to doing with more elaborate equipment in their own location.

Thus, there is an important need for an exercising device or kit which makes many common and aerobic exercises easy to perform in a private setting, a device which is small enough and light weight enough to be easily moved to a desired location and has a compact configuration such that the device is out of the way when not in use. Further, it is desirable to have an exercise or fitness device which can make a variety of typical resistance exercises possible with a single apparatus or exercise device and without requiring numerous benches and large specialized machines. The present disclosure provides such an exercising device which solves those needs.

The present disclosure utilizes in conjunction with a track and a slide having a hook, a resistance band which permits exercises by health and fitness practitioners, both for general strength and conditioning of the body and for rehabilitation of the muscles in arms, legs, back and waist.

The resistance band exercises of the present disclosure are ideal for home or office exercise programs and can be easily incorporated into a training format helping to condition cardiovascular system as well as strengthening specific muscle groups as will be disclosed herein.

SUMMARY

The present disclosure relates to a fitness apparatus, exercising device, or kit which includes a track adapted to be mounted on a support and a combined hook and slide which is reversible on the track so that the opening provided by the hook may extend either upwardly or downwardly. It is to be understood that hook may be a hook that is formed in a j-shape, double-C shape, or other configuration wherein a resistance band or the like may be easily engaged with such device by a user. The combined track and the hook and slide assembly is coupled with a standard resistance band which provides a total body resistance workout.

The method of assembling the slide and hook assembly on the track is very simple and requires little time. Furthermore, the slide and hook assembly can also be easily and quickly removed from the track. Thereafter, the slide and hook assembly can be reversed on the track to perform exercises to be disclosed herein. To install the exercising device, the track is mounted on a wall, door or other vertical support and is secured thereto by means of threaded fasteners placed longitudinally through the track into the support. Prior to mounting the track on the support, the slide and hook assembly may be placed on the track and is moved thereon to one of a plurality of positions provided thereon. Alternatively, the slide and hook assembly may be placed on the track after the track is mount to a vertical surface. After the proper position is selected for the slide and hook assembly, a spring loaded plunger carried by the upper end of the slide is inserted into an opening or hole provided in the track.

Other objects, advantages and novel features of the present disclosure will become more apparent from the following detailed description when taken in conjunction with the accompanying drawings.

DETAILED DESCRIPTION

Figure 1:
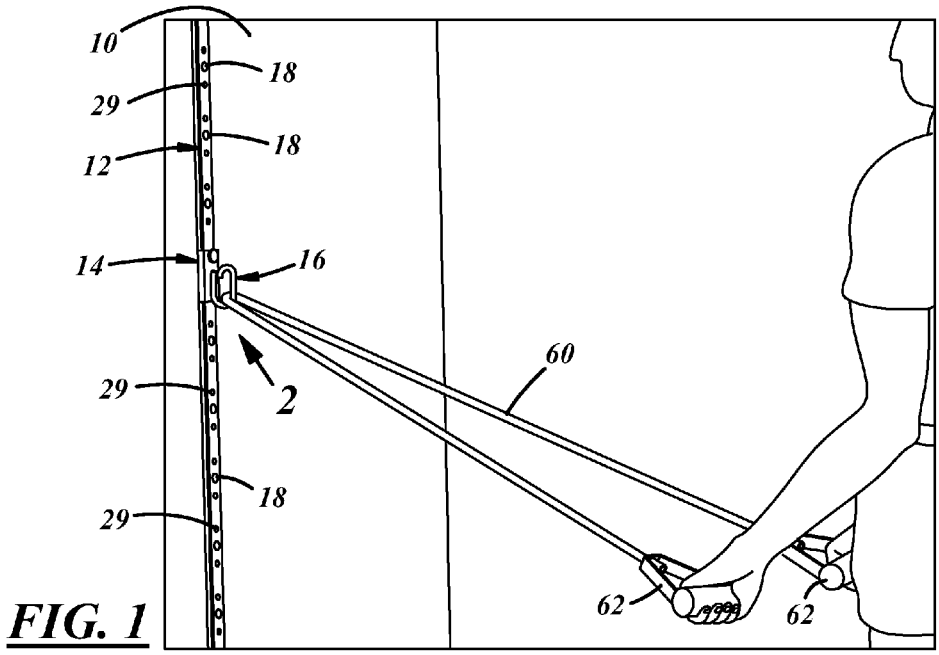
FIG. 1 is a fragmentary perspective view of the resistance apparatus, with the slide in a first position illustrating a person doing a resistance exercise.
Figure 3:
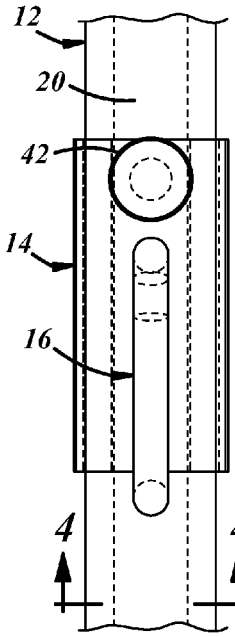
FIG. 3 is a fragmentary elevational view of the hook and slide mounted on the track.
Figure 2:
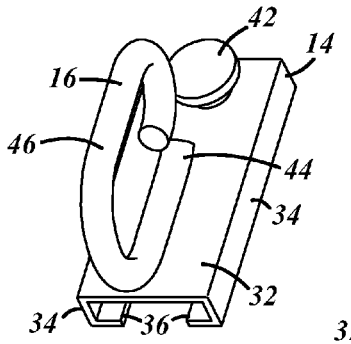
FIG. 2 is a perspective view of the slide and hook assembly, looking in the direction of arrow 2 of FIG. 1.
Figure 4:
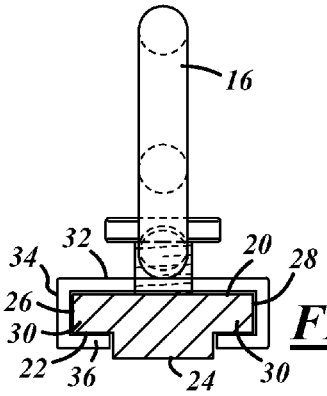
FIG. 4 is a sectional view through the track taken on line 4-4 of FIG. 3.

FIG. 1 illustrates a wall or vertical support 10 onto which is mounted a track 12 which a reversibly mounted slide 14 is slidable on a T-shaped elongated track. The reversibly mounted slide 14 includes a hook 16 secured thereto by welding, brazing or by other means well known in the art. The track 12 may have a T-shaped cross-section as illustrated in FIG. 4 or the track 12 may have a different configuration which similarly engages with the reversibly mounted slide 14. The elongated track 12 includes a plurality of threaded openings or holes 18 extending throughout the length of the strap so that the track 12 may be appropriately affixed and secured to the support 10 by screws or other fastening devices, not shown. At the top of the track 12 a cap, not shown, could be placed.

Elongated track 12 has a front surface 20, an intermediate surface 22 and a back surface 24. Surfaces 20, 22 and 24 are generally parallel to one another as illustrated in FIG. 4. The front surface 20 and the intermediate surface 22 are connected by parallel surfaces 26 and 28 which are located at opposite sides and are perpendicular thereto. The surfaces 20, 22, 26 and 28 form a pair of guide rails 30 at the longitudinal edges of the track 12 as best shown in FIG. 4. A plurality of vertically spaced openings 29 are provided in the track 12 at areas in the front surface 20 between the threaded openings 18.

The slide 14 has a front surface 32, a pair of spaced apart side surfaces 34 and a pair of laterally spaced inwardly turned flanges 36. The slide 14 is mounted on the track 12 by inserting the slide 12 at the upper or lower ends of the track 12 whereby the flanges 36 and side surfaces 34 engage the guide rails 30 as best shown in FIG. 4. Thus, the vertical slide 14 is mounted on the track 12 and it is held in place on the track 12 by a spring loaded plunger 40 which has an enlarged head 42. The plunger 40 is inserted into one of a plurality of holes 29 provided in the track 12 and holds the slide 12 in place in holes not occupied by screws. The spring loaded plunger 40 is located near the upper end of the slide 14. It should be appreciated that the slide and hook assembly may be reversed on the track 12 180° so that the opening for receiving the resistance band faces downwardly.

The hook 16 has a pair of spaced apart legs, with the first leg 44 which is secured to the front surface 32 of the slide 14 being shorter in length than the second leg 46. The lower end of legs 44 and 46 are connected by an upwardly curved U-shaped portion 48 on which the resistance band rests 60 during the exercises. The upper end portion 50 of the first leg 44 is relatively close to the front surface 42 of the slide 14.

Figure 5:
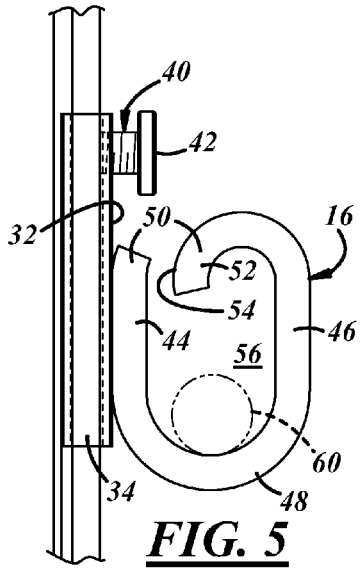
FIG. 5 is a fragmentary elevational view illustrating the hook and slide assembly mounted on the track.

The upper end portion 52 of the second leg 46 has a downwardly extending curved portion which is spaced from the upper end portion 50 of the first leg 44. Such an arrangement between the upper end portion 50 and 52 forms therewith an entrance opening 54 which leads into the interior 56 of the hook 16. The resistance band 60 having handles 62 is inserted through the entrance opening 54 into the interior 56 of the hook 16 as illustrated in FIGS. 1 and 5. It is to be understood the resistance band 60 may be an elastic band (as shown) or may be a rope, chain, cable or the like. The resistance band 60 has an intermediate portion received in the interior of the hook 16 and extends through the entrance opening 54 to the interior 56 to permit a person to grasp the handles 62 of the band 60 in order to perform various resistance exercises.

The present disclosure provides a resistance apparatus which may be used, in one non-limiting example, as a fitness apparatus. For example, many exercises can be performed with the present disclosure utilizing the hook and slide assembly coupled with a standard resistance band. A total body resistance work out can be performed as the hook and slide can be placed at various heights on the track. The wall, or support 10, track or strap 12 and the hook and slide assembly create the resistance for the band 60. The use of the hook and slide assembly permits for the flexibility of positions and quick switching of various resistance bands which are available in heavy, medium and light depending upon the requirements for each exercise. The movements all need to start by taking the slack out of the resistance band before starting the exercise.

In order to appreciate the complexity and usefulness of the present disclosure, brief descriptions of various exercises are provided.

With respect to exercises for the triceps, as shown in FIG. 1, the body faces towards the wall 12, with the elbows close into the body, the forearms at a 90° angle to the floor, palms facing down, with the wrists locked. The person then pulls the forearms straight back until the elbows lock thus tightening the triceps. The person slides the slide and hook assembly all the way to the top of the track and lock by inserting the adjustment screw into the opposite opening 29 with the body facing the wall 12, arms 90° at elbows, palms down with wrists locked, the person pulls forearms straight back until the elbows lock, thereby tightening the triceps.

With respect to exercises for the biceps, the person moves the slide and hook assembly all the way to the bottom of the track 12 and lock. The body is facing the wall 10, arms straight down, palms facing the wall 10 gripping the handles 62 of the resistance band 60. The shoulders to elbows should stay against the body while using the biceps to pull the palms upwards to the shoulders, bending only at the elbows, thus contracting the biceps.

With respect to exercises for the deltoids/shoulders, the hook 16 is positioned at the bottom of the track 12. The person's arms are straight down beside his body, palms inward, body facing either towards the wall 10 or away and with elbows locked. The person lifts arms parallel to the floor with palms still facing downward grasping the band handles 62 thus creating contraction of the Deltoids.

With respect to exercises for the trapezoid muscles, the hook 16 is positioned at the bottom of the track 12. The person's arms are straight down beside his body, palms inward, body facing either towards the wall 10 or away and keeping his arms locked. The person lifts his shoulders to his ears or "shrug" the shoulders thus contracting his Trapezoid.

With respect to exercises for the pectoral muscles or chest muscles, the slide and hook assembly is positioned even with the person's chest, facing away from the wall 10, grasping the handles 62 and pushing the handles 62 straight away from the chest. The person again pushes the handles again away from chest straight out and then return to the chest again thus contracting the muscle on the push out. This exercise is known as Butterflies. The person faces away from the wall 10, grasping the handles 62 of the resistance band 62. The person holds arms out parallel to the floor, with his palms facing away from the wall 10. Keeping the arms locked or with a slight bend, the person contracts the chest muscles by bringing the two palms or fists together in the front while the arms are still fully extended.

With respect to exercises for the deltoid muscles or latissimus muscles which are on the back (complete opposite side of the pectoral chest muscles). The hook/slide is on the same spot on track inlet as was done with chest. With the body facing the wall 10, arms extended forward parallel to the start and with fist together, keep the arms locked or slightly bent. Contract the back (lats & delts) separating the fists and moving the arms from mid position all the way out to either side of the body.

With respect to the exercises for the Latissimum muscles, the person moves the hook/slide assembly to the highest point on the track. The person either sits on the floor or in a chair. Reach body hands upward to grasp handles 62, pull the fists down with elbows tight against the body thereby contracting the "lats".

With respect to the exercises for the Gluteus Maximum/Quad muscles, the person moves the hook/slide assembly to the lowest point. Keep the handles of the resistance band 60 on the shoulders while facing away from the wall and squatting down, no lower than 90°. The person pushes back up to a standing position without locking the knees. On the pushing back up from the squat, the person is contracting the Gluteus and the Quad muscles.

With respect to the exercises for the Calf Muscles, the person moves the hook/slide assembly to the lowest point and grasp the handles and hold them along side of the body, either facing away from the wall 10 or towards the wall. The person raises up on the balls of the feet, thus contracting the calf muscle in the back of the legs. A person can either do one leg at a time or both legs at the same time.

Figure 6:
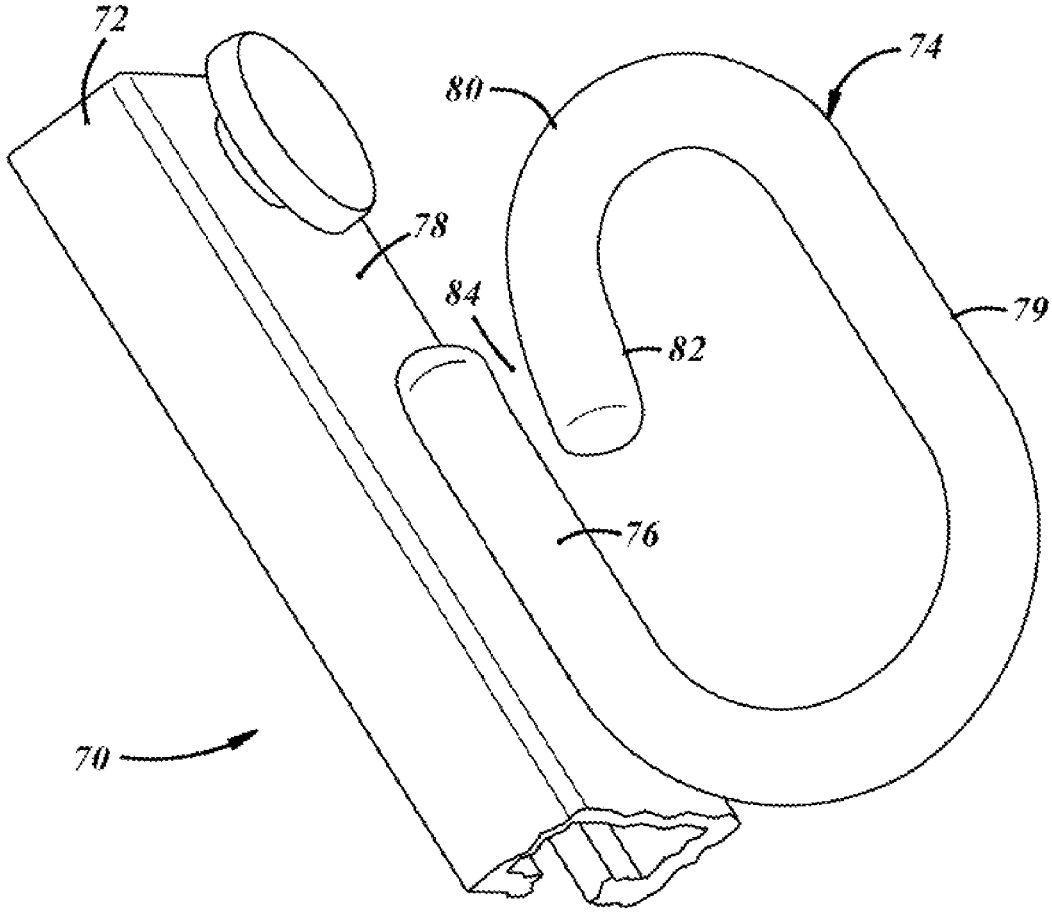
FIG. 6 is a perspective view of another embodiment of the hook and slide assembly of the present disclosure.

A modified slide and hook assembly 70 is illustrated in FIG. 6. The slide 72 is of generally the same construction as slide 14. The hook 74 has been modified whereby the first leg 76 is in contact with the front surface 78 of slide 72. The second leg 79 at its upper end has a downwardly extending curved portion 80 terminating in a finger or extension 82 which extends towards the first leg 76 at an angle and is spaced therefrom. The extension 82 forms with the upper end of the first leg 76 a throat 84 in the entrance opening through which the resistance bands enters the interior of the hook 74.

In either embodiment, the hook should be sitting straight up and down with the opening facing up (due North). The preferred range for the hook would range 180° where the opening could open down towards the ground. The "leg" on the interior of the "hook" would have a preferred length varying in size (still not the full length of the hook). The "leg" also has a preferred angle inside the hook of either straight down or angled at an unspecified degree towards the "slide", still leaving an opening.

The component parts including slide 14, hook 16 and plunger 40 may be made from materials including, but not limited to, plastics and metal, both plated and unplated.

While the present disclosure has been described in conjunction with the specific embodiments outlined above, it is evident that many alternatives, modifications, and variations will be apparent to those skilled in the art. Accordingly, the preferred embodiments of the present disclosure are intended to be illustrative and not limiting. Various changes may be made without departing from the spirit and scope of the present disclosure as defined in the following claims.

What is claimed is:

1. A resistance apparatus comprising:

a track adapted to be secured in a vertical position on a support, the track having a front surface, an intermediate surface and a back surface, the front and intermediate surfaces being connected by parallel surfaces at opposite sides and forming a pair of guide rails at the longitudinal edges of the track;

a plurality of vertically spaced holes in the front surface of the track;

a vertical slide mounted on the track and receiving the guide rails, the vertical slide having a spring loaded plunger near a first end thereof, the vertical slide being moved to a selected location on the track and a plunger is inserted into one of the plurality of vertically spaced holes to hold the slide in place;

a hook having a pair of spaced apart legs, with upper and lower end portions wherein the lower end portions of the legs are connected by an upwardly extending U-shape portion, the upper end portion of the first leg being close to the front surface of the slide, the upper end portion of the second leg having a downwardly extending curved portion which is laterally spaced from the upper end portion of the first leg to form therewith an entrance opening into the interior of the hook; and a resistance band having an intermediate portion received in the interior of the hook through the entrance opening to permit a person to grasp the ends of the band and to perform various resistance exercises.

2. The resistance apparatus of claim 1, wherein the spring loaded plunger has an enlarged knob on the outer end thereof to assist in operating the plunger.

3. The resistance apparatus of claim 1, wherein the curved upper end portion of the second leg has a downwardly extending portion spaced from the first leg and inclined at an angle towards the first leg to form a throat in the entrance opening through which the resistance band enters the interior of the hook.

4. The resistance apparatus of claim 1, wherein the first leg of the hook is secured to the slide by welding or brazing.

5. The resistance apparatus of claim 1, wherein the slide is reversible on the track so that the entrance opening of the hook faces the ground.

6. The resistance apparatus of claim 1, wherein the slide and hook may be placed on the track with the hook arranged straight up and down, with the entrance opening facing upwardly or with the slide and hook reversed 180° on the track resulting in the entrance opening facing downwardly.

7. The resistance apparatus of claim 1, wherein the first leg of the hook has a length less than the combined length of the second leg and the curved upper end portion.

8. The resistance apparatus of claim 1, wherein the curved upper end portion of the second leg is arranged either vertically or at an angle at an unspecified degree towards and spaced from the slide to form the entrance opening.

9. The resistance apparatus of claim 1, wherein the track is provided with a series of additional longitudinally spaced openings in line with and spaced from the threaded openings to receive screws or other fasteners to secure the track to the support.

10. A resistance apparatus comprising:

a track having a series of vertically spaced openings therein;

a vertical slide for mounting on the track;

the slide having a spring loaded plunger near a first end thereof;

the slide, when assembled on the track, being moveable to a selected location on the track and the spring loaded plunger being located in one of the openings provided in the track for holding the slide in place;

a hook having a pair of spaced apart legs, with upper and lower end portions, with the lower end portions of the legs connected by an upwardly extending U-shape portion;

the upper end portion of the first leg being close to the front surface of the slide;

the upper end portion of the second leg having a downwardly extending curved portion which is laterally spaced from the upper end portion of the first leg to form therewith an entrance opening into the interior of the hook; and a resistance band having an intermediate portion which when the apparatus is assembled, the resistance band is received in the interior of the hook through the entrance opening.

11. The resistance apparatus of claim 10, wherein the spring loaded plunger has an enlarged knob on the outer end thereof to assist in operating the plunger.

12. The resistance apparatus of claim 10, wherein the curved upper end portion of the second leg has a downwardly extending portion spaced from the first leg and inclined at an angle towards the first leg to form a throat in the entrance opening through which the resistance band enters the interior of the hook when the resistance apparatus is assembled.

13. The resistance apparatus of claim 10, wherein the first leg of the hook is secured to the slide by welding or brazing.

14. The resistance apparatus of claim 10, wherein the slide is reversible on the track to that the entrance opening of the hook faces the ground when in use.

15. The resistance apparatus of claim 10, wherein the slide and hook may be placed on the track with the hook arranged straight up and down, with the entrance opening facing upwardly or with the slide and hook reversed 180° on the track resulting in the entrance opening facing downwardly when in use.

16. The resistance apparatus of claim 10, wherein the first leg of the hook has a length less than the combined length of the second leg and the curved upper end portion.

17. The resistance apparatus of claim 10, wherein the curved upper end portion of the second leg is arranged either vertically or at an angle at an unspecified degree towards and spaced from the slide to form the entrance opening.

* * * * *